US006418229B1

(12) United States Patent
Staat

(10) Patent No.: US 6,418,229 B1
(45) Date of Patent: Jul. 9, 2002

(54) DIRECTIONAL MICROPHONE, IN PARTICULAR HAVING SYMMETRICAL DIRECTIVITY

(75) Inventor: Raimund Staat, Burgwedel (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 09/023,323

(22) Filed: Feb. 13, 1998

(30) Foreign Application Priority Data

Feb. 17, 1997 (DE) ..... 197 06 074

(51) Int. Cl.[7] ..... H04R 25/00

(52) U.S. Cl. ..... 381/357; 381/356; 381/358; 381/359; 181/158; 181/196; 181/242

(58) Field of Search ..... 181/158, 196, 181/242, 202; 381/356, 357, 358, 359

(56) References Cited

U.S. PATENT DOCUMENTS 4,757,546 A 7/1988 Akino 5,703,957 A * 12/1997 Mcateer ..... 381/92

FOREIGN PATENT DOCUMENTS

| | | |
|---|---|---|
| GB | 536066 | 5/1941 |
| GB | 0969000 | 9/1964 |

* cited by examiner

*Primary Examiner*—Sinh Tran
*Assistant Examiner*—Dionne Harvey
(74) *Attorney, Agent, or Firm*—Reed Smith LLP

(57) ABSTRACT

The present invention relates to a directional microphone, in particular having symmetrical directivity, having an interference tube with a tube axis which is provided with a row of sound inlets arranged at least approximately parallel to tube axis, and which incorporates an electroacoustic transducer in its inside in the vicinity of its rear end face. It is further provided that the row of sound inlets is arranged non-symmetrically to tube axis opposite the outer periphery of interference tube.

16 Claims, 6 Drawing Sheets

DIRECTIONAL MICROPHONE, IN PARTICULAR HAVING SYMMETRICAL DIRECTIVITY

BACKGROUND OF THE INVENTION a) Field of the Invention

The present invention relates to a directional microphone, in particular having symmetrical directivity.

b) Description of the Related Art

A directional microphone normally comprises an interference tube which is provided with sound inlets along the length of its tube axis, which are normally covered with acoustic damping material. The interference tube can be closed at its front end by an acoustic absorber, and at its rear end by a pressure microphone or an electroacoustic transducer, free from reflection. A wave is emitted from each sound inlet in the interference tube which, with lateral acoustic irradiation of the interference tube, are not cophasal, i.e., are not found in phase and interfere in that a lobar directional characteristic results. The interference effect with directional microphones disappears with sound wavelengths which are large compared with the length of the interference tube. This happens typically below 1–3 kHz. In this frequency range the interference tube acts independently of direction on the basis of its sound inlets covered with damping material, as an acoustic low pass for the sound which arrives at the forward side of a membrane of the electroacoustic transducer.

So as to also achieve a directional effect for lower frequencies, the interference tube must be combined with a pressure gradient transducer, which likewise has an acoustic low pass on its rear sound inlet. Both low passes act as delay for the sound which arrives at the forward or the rear side of the electroacoustic transducer membrane. These transit times are added to the directional transit times which require the sound at the forward and rear acoustic inlets of the electroacoustic transducer. Without the above filter, a pressure gradient transducer would show its minimal sensitivity with lateral acoustic irradiation. In an ideal situation, the resulting membrane motion would return to zero, as identical pressure would prevail on both sides of the electroacoustic transducer membrane (extinction). The angle of extinction can, for example, be set at 120° (supercardiod) or 180° (cardiod) through the above-named filter.

A directional effect which is rotation-symmetrical to the interference tube is usually achieved with symmetrically arranged interference tubes and pressure gradient capsules. The interference tube is provided with 2,3 or 4 rows of sound inlet openings and the rear acoustic inlets of the electroacoustic transducer are placed centrally or symmetrical to the center, i.e., the tube axis. Usually the interference tube is protected by a housing, whose sound inlet openings are mostly placed behind a dust proof screen. In-between the housing and the interference tube, a volume or a space is needed which envelopes the interference tube, so that the sound can arrive unhindered at all the interference tube sound inlets. The diameter of the interference tube itself cannot be constructed infinitely small, as otherwise the resistance for the sound waves traveling therein would become too great. Usually an optimal diameter of the interference tube is found which is substantially the same as the membrane diameter of the electroacoustic transducer.

Tubular directional microphones having a small diameter are usually arranged in practice with only a single-sided track of punched holes. Thus space is saved and construction is simpler, as holes are constructed on one side only.

Damping material must be precisely applied and also a protective screen. The rear acoustic or rear sound inlets are always realized symmetrically to the tube axis by circulating holes or slits (see FIG. 3*a*). This is usually necessary if the rear inlet of the electroacoustic transducer is placed on the rear end surface of the transducer and the sound is therefore not directly supplied to the rear side of the membrane. Then problems can arise with the sound supply through the volume or space in the tube behind the electroacoustic transducer due to resonances which are reduced by opening this volume by means of circulating holes or slits.

It has been shown that known tubular directional microphones are either expensive or are relatively large, so that specific operational fields are not available to them. In addition, although smaller tubular directional microphones are known, they have a strongly non-symmetrical directivity (see FIG. 6).

OBJECT AND SUMMARY OF THE INVENTION

It is the primary object of the present invention to create a directional microphone having symmetrical directivity which is compact and small, and can be carried out in a simple construction.

The above object is met in a directional microphone, having symmetrical directivity, encompassing an interference tube with a tube axis, and a forward and a rear end face, which incorporates an electroacoustic transducer in the inside in the vicinity of the rear end face. Both sides of the electroacoustic transducer has sound inlets. The invention is directed to an improvement comprising that sound inlets are arranged on both sides of the electroacoustic transducer non-symmetrically to the tube axis, referring to the outer periphery of the interference tube. Therefore the suggested solution provides for a directional microphone which is strongly non-symmetrical to its center or the tube axis. Through this a directional microphone is created which is constructed in a space saving manner, and therefore can be particularly slim and inconspicuous. In addition, this directional microphone has a symmetrical directivity which can be achieved in spite of this small and compact construction. Deviations from the symmetry of the directivity can only arise with high frequencies if the sound is not sufficiently bent around the microphone so as to arrive in sufficient quantity at the non-symmetrical sound inputs (shading off through the directional tube itself).

So as to achieve a directivity symmetrical to the tube axis, a plurality of punched hole tracks symmetrically distributed around the circumference of the tube are not necessary. Furthermore, it is not necessary that the track of punched holes is located on the tube axis. With the inventive microphone there is the possibility that a track of punched holes can be located on a smaller diameter as compared with the diameter of the interference tube. Thus it is well possible that the rear sound inlets which lead to the rear inlet of the sound transducer, can be arranged just as non-symmetrically to the tube axis, i.e., which lie in the same plane as the forward inlets, and to construct the interference tube suitably. To achieve a symmetrical directivity of a microphone having forward sound inlets located non-symmetrically to the tube axis, the rear sound inlets can be arranged just as non-symmetrically to the tube axis and do not have to be arranged symmetrically to the tube axis. The invention encompasses the extreme case where the track of punched holes is located on the surface zone area respectively on the axis of the interference tube, and represents the position of a diameter of between 0 and the tube diameter as being particularly suitable.

The non-symmetrical arrangement of the sound inlets to the tube axis opposite the outer circumference of the interference tube can be achieved in differing ways. If the interference tube has a round, i.e., circular cross-section, then this non-symmetry can be achieved for the forward sound inlets, arranged between the forward end of the interference tube and the acoustic transducer, which if necessary can be arranged in a row preferably extending parallely to the tube axis, in that the interference tube is provided with a flattening extending in the direction of the tube axis, into which the row of sound inlets is incorporated.

Thereby the central points of the sound inlets can be respectively unevenly or only partially unevenly spaced from one another. It has been shown to be useful if the central points of the individual sound inlets are arranged within the row of sound inlets, having a distance from one another which corresponds at most to half the shortest wavelength to be transmitted.

Likewise the sound inlets can have identical or differing inlet shapes. Furthermore, it has been proven to be advantageous if the sound inlets possess inlet shapes which are respectively different from one another. There is also, of course, the possibility that the sound inlets possess inlet shapes which only differ partially from one another.

On the other hand the differing inlet shapes can be realized differently. It is particularly advantageous if the sound inlet which is directly adjacent to the end of the interference tube opposite the end face incorporating an electroacoustic transducer, has an oval or elliptic inlet shape having at least a longer main axis arranged approximately parallel to the tube axis, and that the successive sound inlets in the row of sound inlets adjoining this sound inlet have a geometric cross-section shape which is similar to the oval inlet shape, having a reducing main axis in comparison with the longer main axis of this sound inlet, preferably a gradually reducing main axis. Thus the last sound inlets can have a round input shape or a round cross-section, whereby the diameter as the main axis of these round cross-sections can be successively decreased. In this connection it has been further shown to be advantageous if the longer main axis reduces gradually, adjusting to the distance between centers of the sound inlets. Furthermore, in place of a plurality of holes as sound inlets, one or more slits can be provided. It is also favorable if the openings or inlets have low forward acoustic impedance. In this connection larger openings or low impedance dampings can be provided.

Except for the non-symmetry as regards the sound inlets, the interference tube itself can have any desired cross-sectional shape. For example the interference tube can have a cylindrical shape. It has been proved to be particularly advantageous if the interference tube tapers out from the end incorporating the electroacoustic transducer in a truncated cone shape. In addition, it has been proved to be useful if an intermediate space or volume of air is provided between an electroacoustic transducer and the end face of the interference tube which is close to the electroacoustic transducer. This intermediate space is in contact with the surroundings through at least one further sound inlet between the electroacoustic transducer and the rear end face of the interference tube. The further sound inlet can therefore be located in a plane with the sound inlets of the row of sound inlets.

For example, the further sound inlet can be so arranged through a single slit on one side that in the center its opening is in alignment with the row of sound inlets of the interference tube. Through this the row of sound inlets arranged in front of the electroacoustic transducer, and the further sound inlet arranged behind the electroacoustic transducer are located in one line or in one plane. Likewise the further sound inlet can be constructed, for example, through small, if need be, round bores. The operating times from any point in space to all the acoustic inlets of the electroacoustic transducer differ from one another by an amount fixed as a result of construction, which does not change if the directional microphone is rotated about its own axis. In the case where the sound does not arrive directly through the rear acoustic inlets to the rear side of the electroacoustic transducer membrane, rather firstly arrives in a volume behind the electroacoustic transducer and then at the individual acoustic inlets of the electroacoustic transducer, the electroacoustic transducer must be constructed acoustically of particularly high impedance and the volume be constructed particularly small. Both requirements harmonize with the requirement—above all—to keep the directional microphone diameter small. In addition, the rear acoustic inlets of the electroacoustic transducer can be used as additional acoustic filters to influence the ratio of the portions of sound which arrive at both sides of the membrane, in favor of the portion which passes the interference tube for higher frequencies.

The rear end of the interference tube opposite the sound transducer can be either closed at the end face or provided with openings. In the latter case, the acoustically active mass is increased with larger wavelengths and thus the frequency response is extended to lower frequencies.

Furthermore, it can be provided that the sound inlets are covered with a damping material on their outer side. If no further structural element is provided on the outer side of the directional microphone, then the damping material can be so-formulated with an inventive microphone having a flattening and an otherwise round cross-section, as to complete the interference tube cross-section to a round cross-section. The same applies if the sound inlets are covered with a protective screen on their outer side.

BRIEF DESCRIPTION OF THE DRAWINGS

The invention will now be described by way of example with the aid of the accompanying drawings.

DESCRIPTION OF THE PREFERRED EMBODIMENTS

Figure 1:
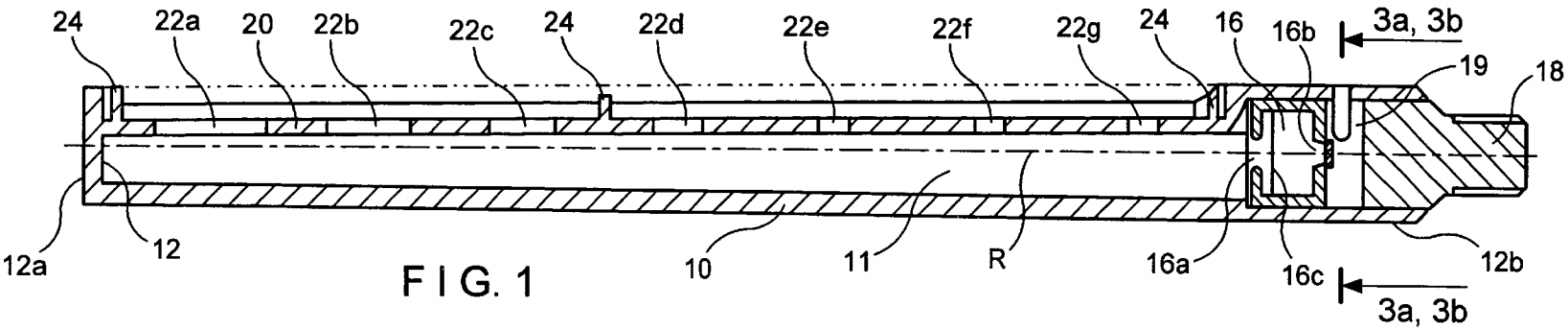
FIG. 1 shows a longitudinal cross-section through an inventive directional microphone.
Figure 2:
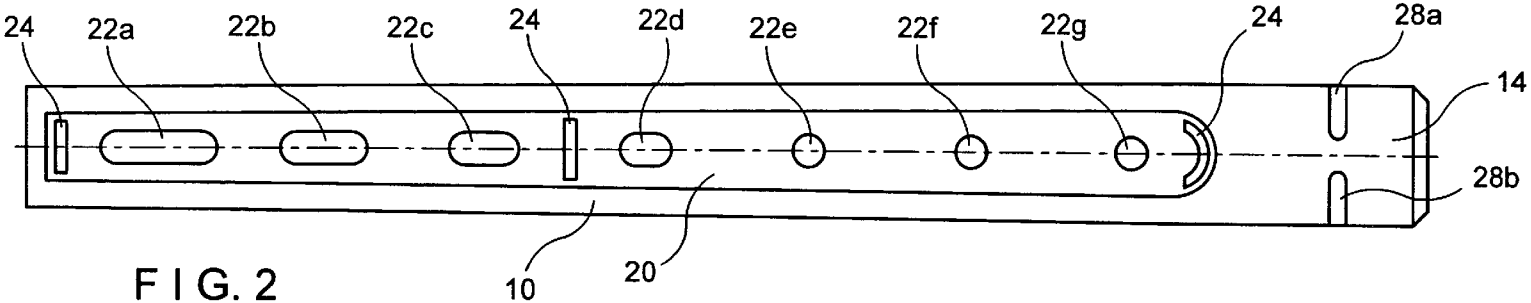
FIG. 2 shows a plan view of the directional microphone shown in FIG. 1.
Figure 8:
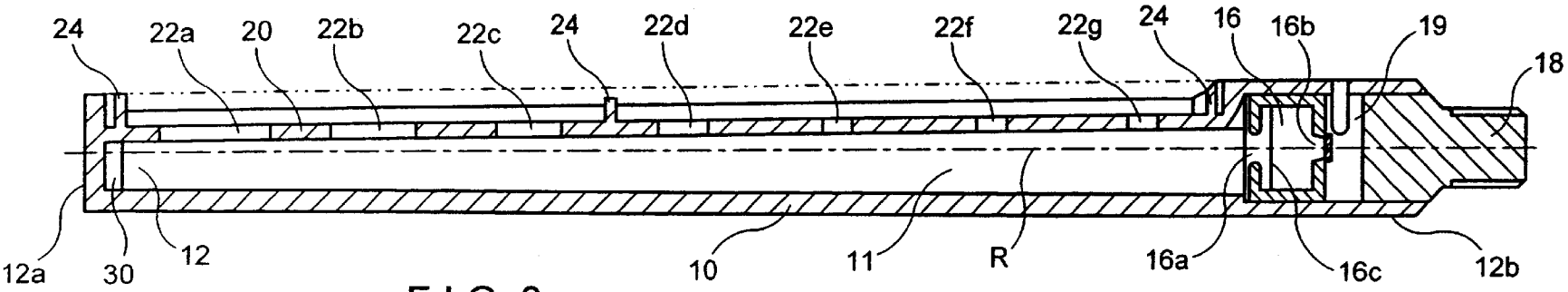
FIG. 8 shows a longitudinal cross-section of the microphone in FIG. 1 including an acoustic absorber.

As can be seen from FIGS. 1 & 2, the inventive directional microphone has a hollow interference tube 10 having a tube axis R which extensively has the shape of a truncated cone. The inner area 11, enclosed in cross-section by interference tube 10 is likewise constructed in a truncated cone shape, identical with the outer periphery of interference tube in cross-section 10. The front end 12 having the narrower cone circular surface of interference tube 10 is closed by an end wall 12*a*. In the inside 11 of interference tube 10, an acoustic absorber can be arranged on end wall 12*a* for a reflection-free closure of interference tube 10, as shown in FIG. 8. An electroacoustic transducer 16, preferably in the form of a microphone capsule is inserted in the area of rear end 14 opposite front end 12 of interference tube 10, whose outer periphery is at least approximately the same as the inner periphery of interference tube 10, and which likewise closes inner area 11 of interference tube 10. Rear end 14 is arranged open, and is closed by a duct 18 of a not further shown closing member of electroacoustic transducer 16, whereby an intermediate space 19 is present between electroacoustic transducer 16 and duct 18.

As can be seen from FIG. 1 electroacoustic transducer 16 has a first acoustic inlet 16*a* turned towards end wall 12, and a second acoustic inlet 16*b*, turned towards duct 18. Between the two acoustic inlets 16*a*, 16*b* is a membrane 16*c* provided inside electroacoustic transducer 16.

As can be best seen from FIG. 3, interference tube 10 is further provided on one side with a flattening 20, extending essentially axially. The flattening encloses a smallest possible pointed angle with tube axis R of interference tube 10. In the flattening 20 there are a plurality of forward sound inlets, in the present case a total of six 22*a* to 22*g*, installed, which connect the inner area 11 of interference tube 10 with the outer side of surroundings. At the forward end 12 of interference tube 10, the present first sound inlet 22*a* has an oval or elliptic inlet shape, having straight sides which extend parallel to one another, whereby the longer main axis of the ellipse extends at least approximately parallel to tube axis R. Sound inlet 22*b* adjoining thereto in the direction of the rear end 14 of interference tube 10 is geometrically similarly constructed to the above-named sound inlet 22*a*, however, the longer main axis of the ellipse which likewise extends parallel to tube axis R, is shorter than the longer main axis of sound inlet 22*a*. Sound inlets 22*c* and 22*d* adjoining thereto in the direction of the rear end 14 of interference tube 10 are likewise geometrically similar to the first sound inlet 22*a*, however, with a gradually reducing smaller length for their respective longer main axis. As opposed to this, sound inlets 22*e* to 22*g* are constructed having a circular inlet shape as a special shape of an ellipse where, however, the diameter of sound inlets 22*e* to 22*g* gradually reduce from sound inlet 22*e* to sound inlet 22*g*.

As can be seen, in particular from FIG. 2, the central points of all the sound inlets 22*a* to 22*g* lie along a line extending at least approximately parallel to the tube axis. Thus the central points of sound inlets 22*a* to 22*g* are arranged having the same spacing from one another, the present case being respectively 9 mm. Through this the reduction in length of the longer main axis or diameter of sound inlets 22*a* to 22*g* from left to right, relating to FIG. 2, results in a constant reduction in the form of a row.

As can be seen from FIGS. 1 and 2, securing or assembly flanges 24 are provided on the flattening 20 in front of the first sound inlet 22*a*, between the third and fourth sound inlet 22*c*, 22*d* and after the last sound inlet 22*g*, which serve for attaching a not shown protective screen to interference tube 10. The protective screen can thereby be so shaped that the formation "truncated cone with flattening" of interference tube 10 is completed again by the protective screen to the circular truncated cone shape, in spite of the flattening 20.

Furthermore, sound inlets 22*a* to 22*g* can be covered by a not shown damping material, which can be precisely applied to the outer side of flattening 20.

Figure 3A:
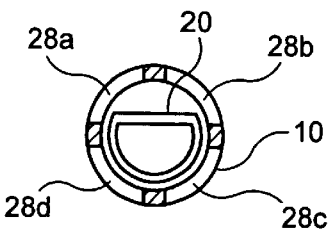
FIG. 3*a* shows a cross-section along line III—III of FIG. 1 having an unfavorable embodiment of the directional microphone rear sound inlets.

As already mentioned above, electroacoustic transducer 16 is arranged in the region of the rear end 14. On the side turned towards the second acoustic inlet 16*b* of electroacoustic transducer 16, the interference tube 10 is provided with further rear sound inlets 28*a*, 28*b*, as can be seen in particular from FIG. 3*b*. The sound can arrive through further sound inlets 28*a*, 28*b* at the second rear acoustic inlet 16*b* of the electroacoustic transducer via intermediate space 19. Both sound inlets 28*a*, 28*b* are located in the middle in the same plane as sound inlets 22*a* to 22*g* of the row of sound inlets between the forward end face 12 of interference tube 10 and electroacoustic transducer 16. As a result, therefore, sound inlets 22*a* to 22*g*, likewise, 28*a*, 28*b* are arranged non-symmetrically to the outer periphery of interference tube 10. Contrary to this, FIG. 3*a* shows an example of an unsuitable arrangement of rear sound inlets 28*a* to 28*b*, as these are arranged having an angular pitch of about 90°, uniformly around the periphery of interference tube 10.

Figure 3B:
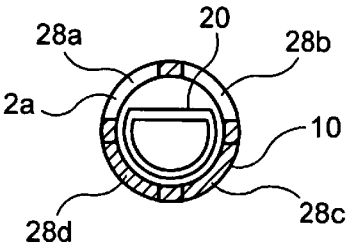
FIG. 3*b* is a cross-section along line III—III of FIG. 1 of the inventive microphone.

It is to be noted that sound inlets 28*a*, 28*b* can be constructed not only as slits as shown in FIG. 3*b*, but also, for example, as four small, preferably round holes or bores.

Figure 4:
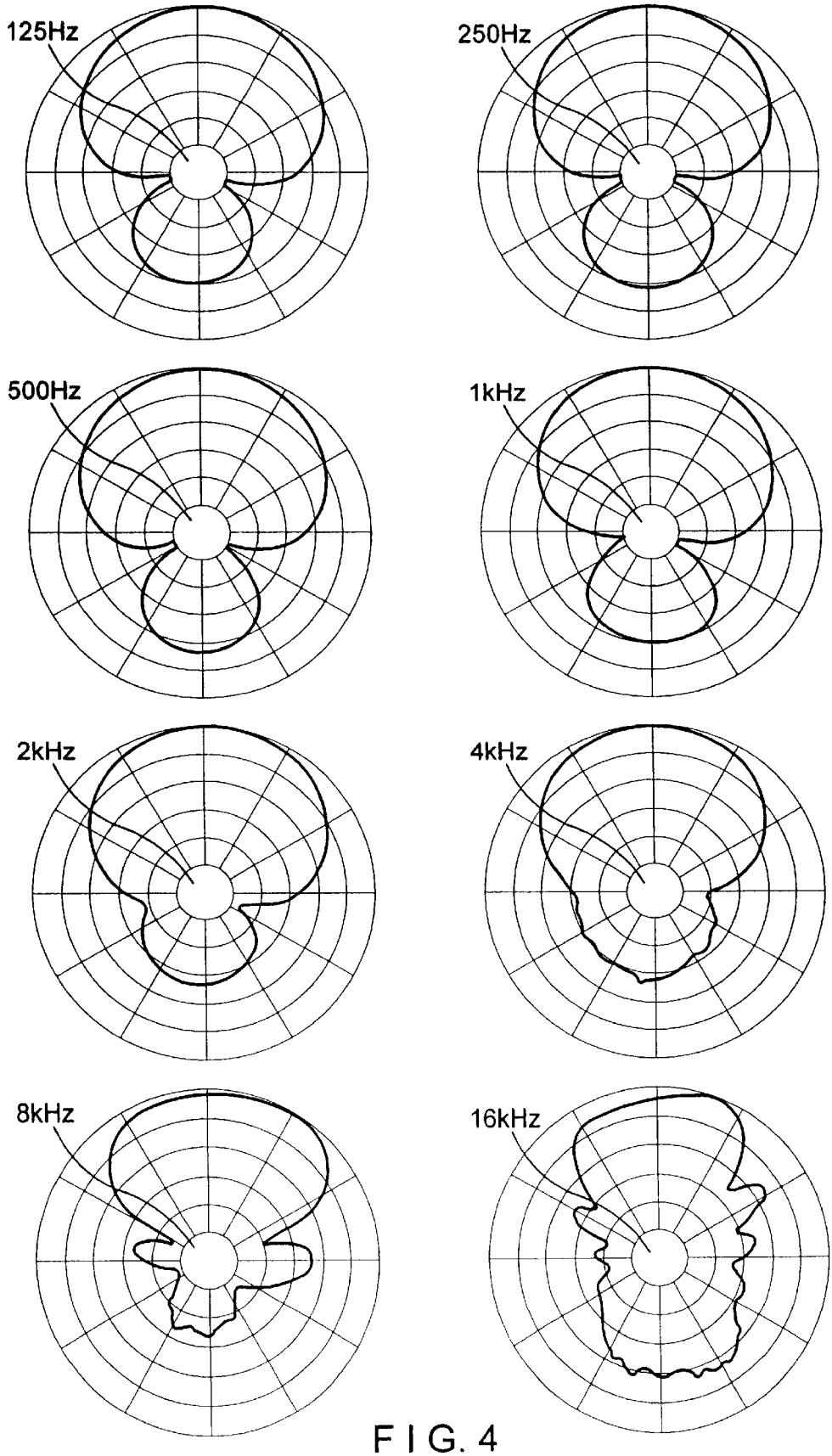
FIG. 4 is a directional diagram of an inventive directional microphone.
Figure 5A:
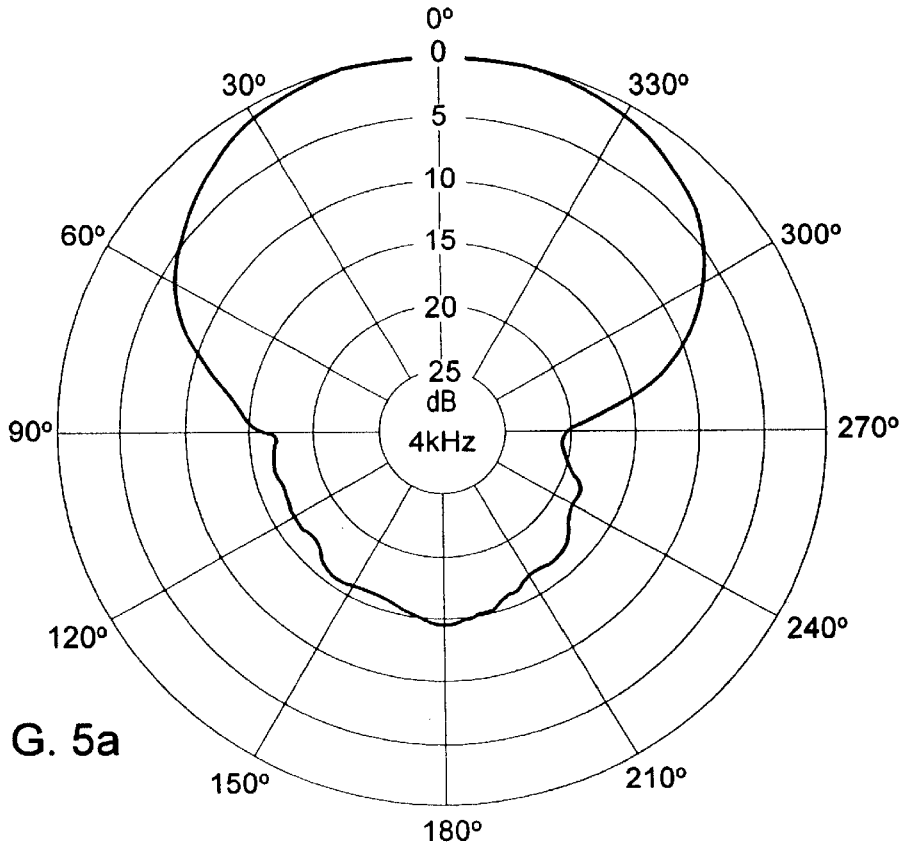
FIG. 5*a* is a directional diagram for an inventive directional microphone having a specific frequency.
Figure 5B:
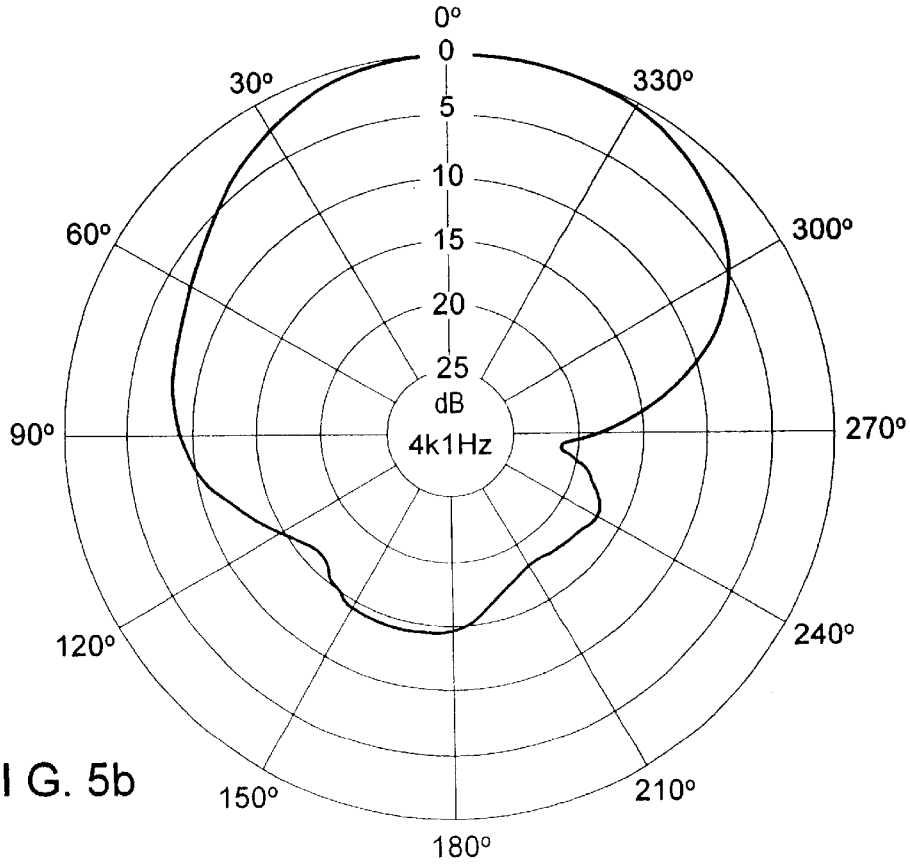
FIG. 5*b* is a directional diagram corresponding to FIG. 5*a,* where the directional microphone has rear sound inputs symmetrical to the central axis.
Figure 6:
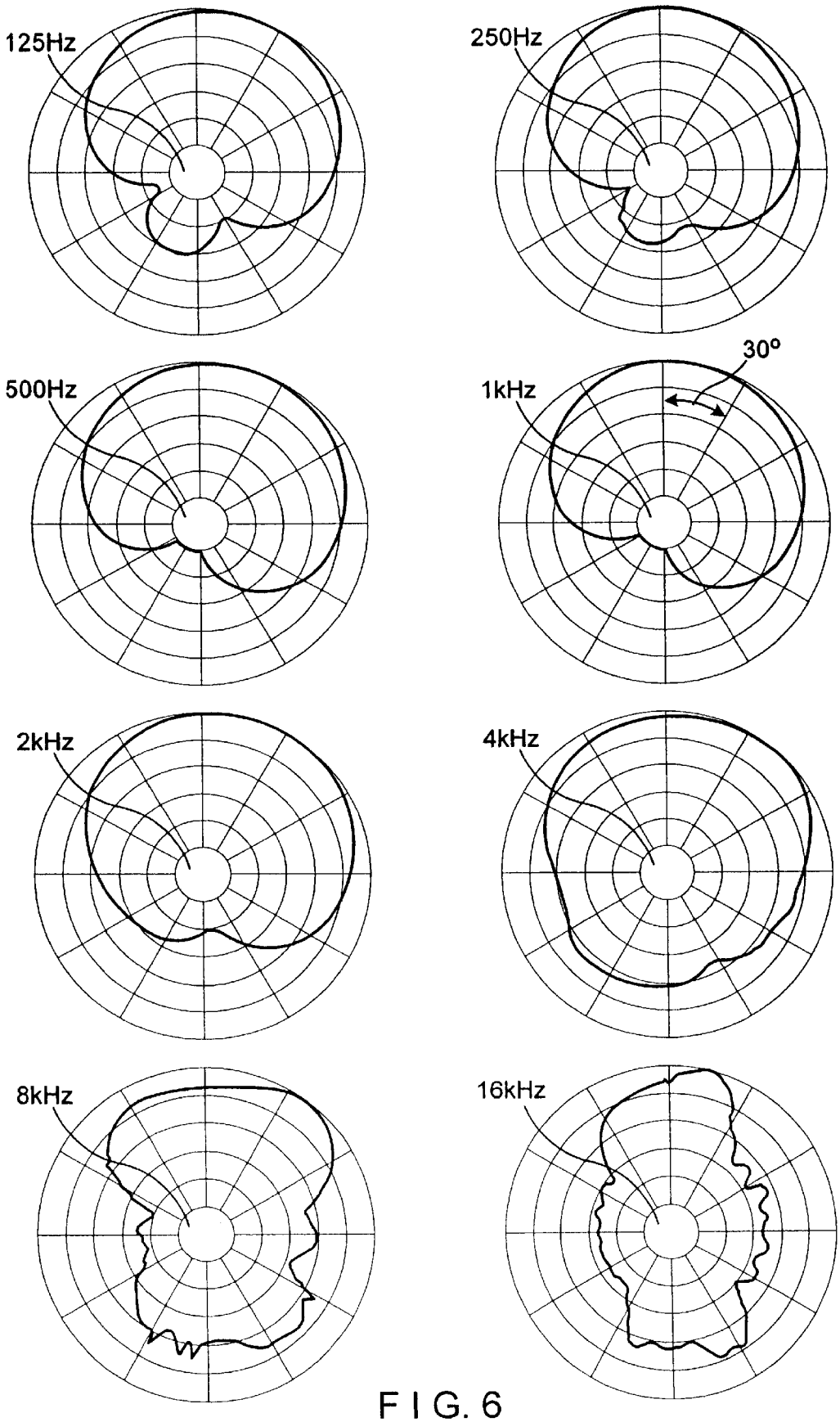
FIG. 6 is a directional diagram of a known directional microphone with strong non-symmetry.

As can be seen from FIG. 4, the inventive directional microphone possesses a symmetrical directivity. Contrary to this, FIG. 6 show the directivity of a known directional microphone, which shows a non-symmetrical directional characteristic. FIG. 5 shows how the directional characteristic of the inventive microphone would develop non-symmetrically if sound inlets 28*c*, 28*d*—as in the case of FIG. 3*a*—were also present. If only sound inlets 28*a*, 28*b* are present, then the directional diagram is symmetrical as is shown in FIG. 5*a*. On the contrary. FIG. 5*b* shows a non-symmetrical directional diagram which could be formed with an inventive microphone having an arrangement of sound inlets 28*a* to 28*d* symmetrical to the middle axis of the directional microphone, as is shown in FIG. 3*a*.

Figure 7:
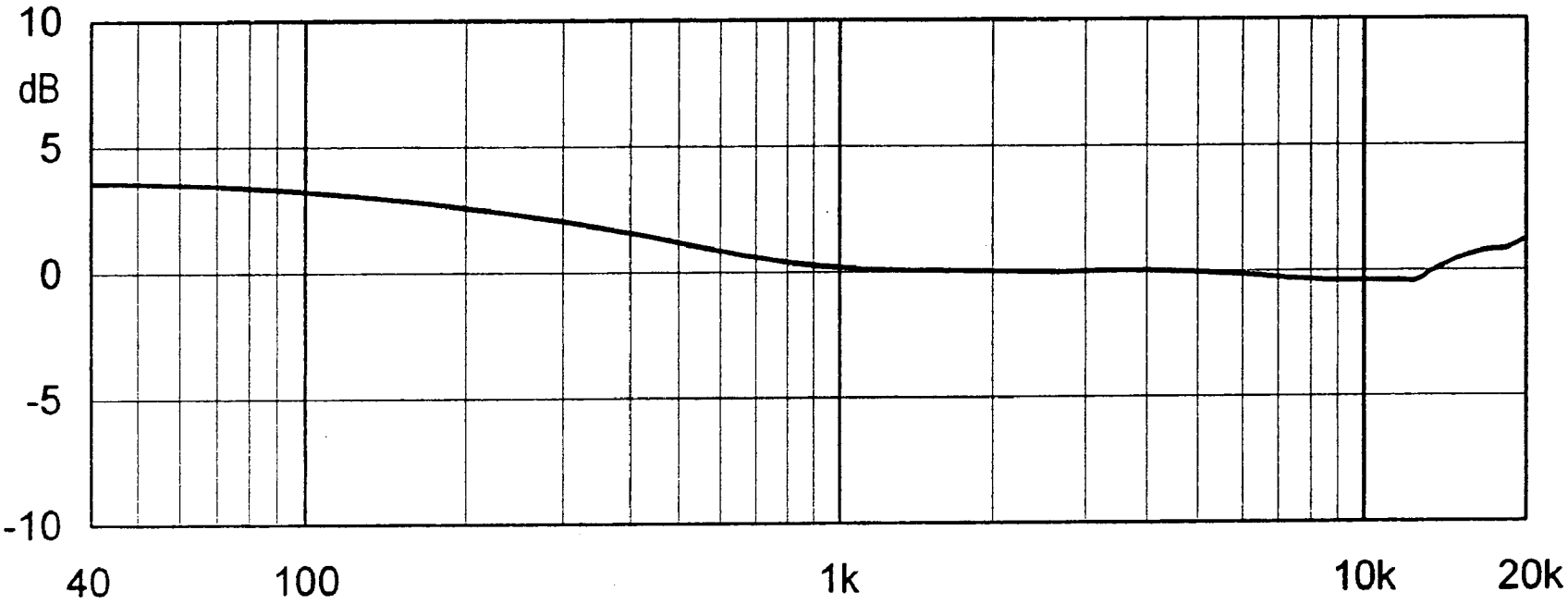
FIG. 7 is a frequency response of an inventive directional microphone with/without an end wall 12*a;*
Figure 9:
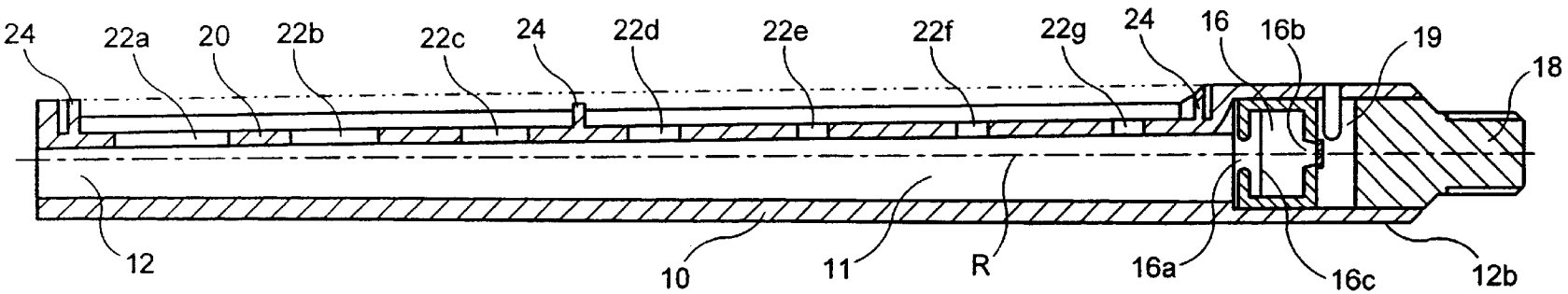
FIG. 9 shows a longitudinal cross-section of the inventive directional microphone in accordance with another embodiment of the present invention.

FIG. 7 shows the frequency response of an inventive directional microphone which is constructed with/without end wall 12*a*. Without end wall 12*a* the low frequencies are lifted. FIG. 9 shows the inventive directional microphone without end wall 12*a* (i.e., tube 10 is open at front end 12.

While the foregoing description and drawings represent the preferred embodiments of the present invention, it will be obvious to those skilled in the art that various changes and modifications may be made therein without departing from the true spirit and scope of the present invention.

What is claimed is:

1. In a directional microphone having symmetrical directivity, encompassing an interference tube with a tube axis, and a forward and a rear end face, which incorporates an electroacoustic transducer in the inside in the vicinity of said rear end face, and wherein both sides of the electroacoustic transducer have transducer sound inlets, an improvement comprising that said interference tube includes tube sound inlets arranged on both sides of the electroacoustic transducer, non-symmetrically relative to said tube axis, with reference to an outer periphery of said interference tube.

2. In a directional microphone having symmetrical directivity, encompassing an interference tube with a tube axis, and a forward and a rear end face, which incorporates an electroacoustic transducer in the inside in the vicinity of said rear end face, and wherein both sides of the electroacoustic transducer have transducer sound inlets, an improvement comprising that said interference tube includes tube sound inlets arranged on both sides of the electroacoustic transducer, non-symmetrically relative to said tube axis, with reference to an outer periphery of said interference tube, wherein certain ones of said sound inlets are arranged in a row on a diameter which is smaller than the diameter of the interference tube.

3. The directional microphone according to claim 2, wherein the interference tube is provided with an axially extending flattening on its outer side, into which the row of tube sound inlets is incorporated.

4. The directional microphone according to claim 2, wherein the central points of said certain of said tube sound inlets are arranged having the same spacing from one another within the row of tube sound inlets.

5. The directional microphone according to claim 1, wherein said tube sound inlets have inlet shapes which are respectively different from one another.

6. The directional microphone according to claim 5, wherein said sound inlet directly adjacent to said forward end has an oval inlet shape having a main axis arranged at least parallel to said tube axis, and wherein tube sound inlets adjoining this sound inlet in a consecutive row have an inlet shape which is geometrically similar to the oval inlet shape, having a reducing main axis in comparison with the main axis of said tube sound inlet.

7. The directional microphone according to claim 1, wherein said interference tube tapers in a truncated cone shape from its rear end to its front end.

8. The directional microphone according to claim 1, wherein said interference tube is open at its forward end.

9. The directional microphone according to claim 1, wherein said interference tube is closed at its forward end.

10. The directional microphone according to claim 1, wherein said interference tube has an absorber on the inside at its forward end.

11. The directional microphone according to claim 1, wherein at least one tube sound inlet is arranged between the electroacoustic transducer and the rear end of said interference tube, which is located in a plane with certain ones of said tube sound inlets between the forward end of said interference tube and the electroacoustic transducer.

12. The directional microphone according to claim 11, wherein said tube sound inlet arranged between the electroacoustic transducer and the rear end of the interference tube is constructed in the form of a slit.

13. The directional microphone according to claim 1, wherein said tube sound inlets are provided with a damping material on their outer side.

14. The directional microphone according to claim 1, wherein said tube sound inlets are covered by a protective screen on their outer side.

15. The directional microphone of claim 6, wherein said main axis is gradually reducing.

16. The directional microphone of claim 12, wherein said slit has an axis extending transversely to the tube axis.

* * * * *